US007637968B2

(12) United States Patent
Murphy

(10) Patent No.: US 7,637,968 B2
(45) Date of Patent: Dec. 29, 2009

(54) TRIACYLGLYCEROL BASED WAX FOR USE IN CONTAINER CANDLES

(75) Inventor: Timothy A. Murphy, Derby, KS (US)

(73) Assignee: Elevance Renewable Sciences, Inc., Bolingbrook, IL (US)

( * ) Notice: Subject to any disclaimer, the term of this patent is extended or adjusted under 35 U.S.C. 154(b) by 600 days.

(21) Appl. No.: 10/950,127

(22) Filed: Sep. 24, 2004

(65) Prior Publication Data

US 2005/0060927 A1 Mar. 24, 2005

Related U.S. Application Data

(63) Continuation of application No. 10/292,378, filed on Nov. 12, 2002, now Pat. No. 6,797,020.

(51) Int. Cl.
*C11C 5/00* (2006.01)

(52) U.S. Cl. ..... 44/275

(58) Field of Classification Search ..... 44/275; 431/288

See application file for complete search history.

(56) References Cited

U.S. PATENT DOCUMENTS 6,797,020 B2 * 9/2004 Murphy ..... 44/275

* cited by examiner

*Primary Examiner*—Cephia D Toomer
(74) *Attorney, Agent, or Firm*—Brinks Hofer Gilson & Lione

(57) ABSTRACT

A triacylglycerol based wax, which may be used to form container candles, is disclosed. The triacylglycerol-based wax includes a triacylglycerol component and a polyol fatty acid partial ester component. The triacylglycerol-based wax typically has a melting point of about 49° C. to 58° C. The triacylglycerol-based wax also generally has an Iodine Value of about 45 to 65. The triacylglycerol component tends to have a fatty acid composition including 5 to 13 wt. % 16:0 fatty acid. Further, the fatty acid composition generally comprises about 45 to 60 wt. % 18:1 fatty acid. The fatty acid composition also generally comprises about 30 to 45 wt. % 18:0 fatty acid. The wax preferably contains little or no paraffin and free fatty acid. The polyol partial ester component is preferably a glycerol monoester of palmitic and stearic fatty acids, and is commonly present as less than about 5 wt. % of the wax.

40 Claims, No Drawings

TRIACYLGLYCEROL BASED WAX FOR USE IN CONTAINER CANDLES

CROSS-REFERENCE TO RELATED PATENT APPLICATIONS

This application is a Continuation of U.S. application Ser. No. 10/292,378, filed Nov. 12, 2002, incorporated herein by reference in its entirety.

BACKGROUND

For a long time, beeswax was has been in common usage as a natural wax for candles. Over one hundred years ago, paraffin came into existence, in parallel with the development of the petroleum refining industry. Paraffin is produced from the residue leftover from refining gasoline and motor oils. Paraffin was introduced as a bountiful and low cost alternative to beeswax, which had become more and more costly and in more and more scarce supply.

Today, paraffin is the primary industrial wax used to produce candles. Conventional candles produced from a paraffin wax material typically emit a smoke and can produce a bad smell when burning. In addition, a small amount of particles ("particulates") can be produced when the candle burns. These particles may affect the health of a human when breathed in.

Accordingly, it would be advantageous to have other materials which can be used to form clean burning base wax for forming candles. If possible, such materials would preferably be biodegradable and be derived from renewable raw materials. The candle base wax es should preferably have physical characteristics, e.g., in terms of melting point, hardness and/or malleability, that permit the material to be readily formed into candles having a pleasing appearance and/or feel to the touch, as well as having desirable olfactory properties.

Additionally, there are several types of candles, including taper, votive, pillar, container candles and the like, each of which places its own unique requirements on the wax used in the candle. For example, container candles, where the wax and wick are held in a container, typically glass, metal or the like, require lower melting points, specific burning characteristics such as wider melt pools, and should desirably adhere to the container walls. The melted wax should preferably retain a consistent appearance upon resolidification.

In the past, attempts to formulate candle waxes from vegetable oil-based materials have often suffered from a variety of problems. For example, relative to paraffin-based candles, vegetable oil-based candles have been reported to exhibit one or more disadvantages such as cracking, air pocket formation, and a natural product odor associated with soybean materials. Various soybean-based waxes have also been reported to suffer performance problems relating to optimum flame size, effective wax and wick performance matching for an even burn, maximum burning time, product color integration and/or product shelf life. In order to achieve the aesthetic and functional product surface and quality sought by consumers of candles, it would be advantageous to develop new vegetable oil-based waxes that overcome as many of these deficiencies as possible.

SUMMARY

The present compositions relate to waxes for use in candles having low paraffin content and methods of producing such candles. The candles are typically formed from a triacylglycerol-based wax, such as vegetable oil-based wax, a biodegradable material produced from renewable resources. Since the candles are formed from a material with a low paraffin content and preferably are substantially devoid of paraffin, the candles are generally clean burning, emitting very little soot. The combination of low soot emission, biodegradability and production from renewable raw material makes the present candle a particularly environmentally friendly product.

The present wax is typically solid, firm but not brittle, generally somewhat malleable, has no free oil visible and is particularly good for use in forming container candles. The present waxes are also capable of providing consistent characteristics, such as appearance, upon cooling and resolidification (e.g., after being burned in a candle) of the melted wax. The wax is desirably formulated to promote surface adhesion to prevent the candle from pulling away from the container when the candle cools. In addition, it is desirable that the wax is capable of being blended with natural color additives to provide an even, solid color distribution.

The triacylglycerol-based wax which may be used to form the present candles is typically solid, firm but not brittle, generally somewhat malleable, with no free oil visible. The wax generally has a melting point of about 120 to 137° F. (circa 49 to 58° C.) and includes a triacylglycerol component and a polyol fatty acid partial ester component. The melting point is generally about 50 to 55° C. (circa 122 to 131° F.) if the wax is used in a container candle.

In general, oils extracted from any given plant or animal source comprise a mixture of triacylglycerols characteristic of the specific source. The mixture of fatty acids isolated from complete hydrolysis of the triacylglycerols and/or other fatty acid esters in a specific sample are referred herein to as the "fatty acid composition" of that sample. By the term "fatty acid composition" reference is made to the identifiable fatty acid residues in the various esters. The distribution of fatty acids in a particular oil or mixture of esters may be readily determined by methods known to those skilled in the art, e.g., via gas chromatography or conversion to a mixture of fatty acid methyl esters followed by analysis by gas chromatography.

Waxes based solely on oils with low palmitic acid (16:0) amounts tend to suffer from a number of problems. For instance, upon cooling the wax tends to segregate into separate portions giving the wax a modeled look as opposed to an even, creamy appearance. Addition of a polyol fatty acid partial ester such as a glycerol fatty acid monoester is believed to mitigate some of these drawbacks.

The wax is commonly predominantly made up of a mixture of the triacylglycerol component and the polyol fatty acid partial ester component, e.g., the wax commonly includes at least about 70 wt. % of the triacylglycerol component and about 3 to 10 wt. % of the polyol partial ester component. Typically, the triacylglycerol-based wax has an Iodine Value of about 45 to 65. The triacylglycerol component generally has a fatty acid composition which includes about 35 to 55 wt. % total of saturated fatty acids. The triacylglycerol component also generally has a fatty acid composition which includes about 45 to 60 wt. % 18:1 fatty acids. The triacylglycerol component further generally has a fatty acid composition which includes 30 to about 45 wt. % 18:0 fatty acids. Finally, the triacylglycerol component generally has a fatty acid composition which includes 5 to 13 wt. % 16:0 fatty acids.

The polyol fatty acid partial ester component can be derived from partial saponification of a vegetable-oil based material and consequently may include a mixture of two or more fatty acids. For example, the polyol fatty acid partial ester component may suitably include polyol partial esters of palmitic acid and/or stearic acid, e.g., where at least about 90 wt. % of the fatty acid which is esterified with the polyol is palmitic acid, stearic acid or a mixture thereof. Examples of suitable polyol partial esters include fatty acid partial esters of glycerol and/or sorbitan, e.g., glycerol and/or sorbitan monoesters of mixtures of fatty acids having 14 to 24 carbon atoms. More desirably, at least about 90 wt. % of the fatty acyl groups in the polyol partial esters have 16 or 18 carbon atoms. As employed herein, the term "fatty acyl group" refers to an acyl group ("—C(O)R") which includes an aliphatic chain (linear or branched).

The triacylglycerol component may suitably be chosen to have a melting point of about 49° C. to 58° C. (circa 120° F. to 137° F.); more typically about 50° C. to 55° C. (circa 122° F. to 131° F.) when used as a container candle wax. One embodiment of such a triacylglycerol stock can be formed by blending fully hydrogenated and partially hydrogenated vegetable oils to produce a blend with an Iodine Value of about 45 to 65 and the desired melting point. For example, a suitable triacylglycerol stock can be formed by blending appropriate amounts of fully hydrogenated soybean oil with a partially hydrogenated soybean oil having an Iodine Value of about 60 to 75. As used herein, a "fully hydrogenated" vegetable oil refers to a vegetable oil which has been hydrogenated to an Iodine Value of no more than about 5. The term "hydrogenated" is used herein to refer to fatty acid ester-based stocks that are either partially and fully hydrogenated. Instead of employing a highly hydrogenated vegetable oil, a highly unsaturated triacylglycerol material derived from precipitating a hard fat fraction from a vegetable oil may be employed. Hard fat fractions obtained in this manner are predominantly composed of saturated triacylglycerols.

It is generally advantageous to minimize the amount of free fatty acid(s) in the triacylglycerol-based wax. Since carboxylic acids are commonly somewhat corrosive, the presence of fatty acid(s) in a triacylglycerol-based wax can increase its irritancy to skin. The present triacylglycerol-based wax generally has free fatty acid content ("FFA") of no more than about 1.0 wt. % and, preferably no more than about 0.5 wt. %.

It has been reported that a candle with a string-less wick can be formed by suspending fine granular or powdered material, such as silica gel flour or wheat fiber in a vegetable oil such as soybean oil, cottonseed oil and/or palm oil. The inclusion of particulate material in a candle wax can result in a two phase material and alter the visual appearance of a candle. Accordingly, the present triacylglycerol-based wax is preferably substantially free (e.g., includes no more than about 0.5 wt. %) of particulate material. As used herein, the term "particulate material" refers to any material that will not dissolve in the triacylglycerol component of the wax, when the wax is in a molten state.

The triacylglycerol-based wax may also include minor amounts of other additives to modify the properties of the waxy material. Examples of types of additives which may commonly be incorporated into the present candles include colorants, fragrances (e.g., fragrance oils), insect repellants and migration inhibitors.

If the present wax is used to produce a candle, the same standard wicks that are employed with other waxes (e.g., paraffin and/or beeswax) can be utilized. In order to fully benefit from the environmentally-safe aspect of the present wax, it is desirable to use a wick which does not have a metal core, such as a lead or zinc core. One example of a suitable wick material is a braided cotton wick.

The present candles may be formed by a method which includes heating the triacylglycerol-based wax to a molten state and introduction of the molten triacylglycerol-based wax into a mold which includes a wick disposed therein. The molten triacylglycerol-based wax is cooled in the mold to solidify the wax.

DETAILED DESCRIPTION OF THE PREFERRED EMBODIMENTS

The physical properties of a triacylglycerol are primarily determined by (i) the chain length of the fatty acyl chains, (ii) the amount and type (cis or trans) of unsaturation present in the fatty acyl chains, and (iii) the distribution of the different fatty acyl chains among the triacylglycerols that make up the fat or oil. Those fats with a high proportion of saturated fatty acids are typically solids at room temperature while triacylglycerols in which unsaturated fatty acyl chains predominate tend to be liquid. Thus, hydrogenation of a triacylglycerol stock ("TAGS") tends to reduce the degree of unsaturation and increase the solid fat content and can be used to convert a liquid oil into a semisolid or solid fat. Hydrogenation, if incomplete (i.e., partial hydrogenation), also tends to result in the isomerization of some of the double bonds in the fatty acyl chains from a cis to a trans configuration. By altering the distribution of fatty acyl chains in the triacylglycerol moieties of a fat or oil, e.g., by blending together materials with different fatty acid compositions, changes in the melting, crystallization and fluidity characteristics of a triacylglycerol stock can be achieved.

Herein, when reference is made to the term "triacylglycerol-based material" the intent is to refer to a material made up predominantly of triacylglycerols, i.e., including at least about 50 wt. %, more typically including at least about 70 wt. % and, more desirably including about 85 wt. % or more triacylglycerol(s).

As employed herein, the terms "triacylglycerol stock" and "triacylglycerol component" are used interchangeably to refer to materials that are made up entirely of one or more triacylglycerol compounds. Commonly, the triacylglycerol stock or triacylglycerol component is a complex mixture triacylglycerol compounds, which very often are predominantly derivatives of C16 and/or C18 fatty acids. The triacylglycerol stock, whether altered or not, is commonly derived from various animal and/or plant sources, such as oil seed sources. The terms at least include within their scope: (a) such materials which have not been altered after isolation; (b) materials which have been refined, bleached and/or deodorized after isolation; (c) materials obtained by a process which includes fractionation of a triacylglycerol oil; and, also, (d) oils obtained from plant or animal sources and altered in some manner, for example through interesterification and/or partial hydrogenation. Herein, the terms "triacylglycerols" and "triglycerides" are intended to be interchangeable. It will be understood that a triacylglycerol stock may include a mixture of triacylglycerols, and a mixture of triacylglycerol isomers. By the term "triacylglycerol isomers," reference is meant to triacylglycerols which, although including the same esterified carboxylic acid residues, may vary with respect to the location of the residues in the triacylglycerol. For example, a triacylglycerol oil such as a vegetable oil stock can include both symmetrical and unsymmetrical isomers of a triacylglycerol molecule which includes two different fatty acyl chains (e.g., includes both stearate and oleate groups).

Any given triacylglycerol molecule includes glycerol esterified with three carboxylic acid molecules. Thus, each triacylglycerol includes three fatty acid residues. In general, oils extracted from any given plant or animal source comprise a mixture of triacylglycerols, characteristic of the specific source. The mixture of fatty acids isolated from complete hydrolysis of the triacylglycerols in a specific source is referred to herein as a "fatty acid composition." By the term "fatty acid composition" reference is made to the identifiable fatty acid residues in the various triacylglycerols. The distribution of specific identifiable fatty acids is characterized herein by the amounts of the individual fatty acids as a weight percent of the total mixture of fatty acids obtained from hydrolysis of the particular mixture of esters. The distribution of fatty acids in a particular oil, fat or ester stock may be readily determined by methods known to those skilled in the art, such as by gas chromatography.

Palmitic acid ("16:0") and stearic acid ("18:0") are saturated fatty acids and triacylglycerol acyl chains formed by the esterification of either of these acids do not contain any carbon-carbon double bonds. The nomenclature in the above abbreviations refers to the number of total carbon atoms in a fatty acid (or fatty acyl group in an ester) followed by the number of carbon-carbon double bonds in the chain. Many fatty acids such as oleic acid, linoleic acid and linolenic acid are unsaturated, i.e., contain one or more carbon-carbon double bonds. Oleic acid is an 18 carbon fatty acid with a single double bond (i.e., an 18:1 fatty acid), linoleic acid is an 18 carbon fatty acid with two double bonds or points of unsaturation (i.e., an 18:2 fatty acid), and linolenic is an 18 carbon fatty acid with three double bonds (i.e., an 18:3 fatty acid).

The fatty acid composition of the triacylglycerol stock which makes up a significant portion of the present triacylglycerol-based wax generally consists predominantly of fatty acids having 16 and 18 carbon atoms. The amount of shorter chain fatty acids, i.e., fatty acids having 14 carbon atoms or less in the fatty acid composition of the triacylglycerols is generally very low, e.g., no more than about 5.0 wt. % and more typically no more than about 1.0 or 2.0 wt. %. The triacylglycerol stock generally includes a moderate amount of saturated 16 carbon fatty acid, e.g., at least about 5 wt. % and typically no more than about 15 wt. %. One type of suitable triacylglycerol stocks include about 8 wt. % to 12 wt. % saturated 16 carbon fatty acid, such as those stocks derived from soybean oil.

The wax is commonly predominantly made up of a mixture of the triacylglycerol component and the polyol fatty acid partial ester component, e.g., the wax commonly includes at least about 70 wt. % of the triacylglycerol component and about 3 to 10 wt. % of the polyol partial ester component. Typically, the triacylglycerol-based wax has an Iodine Value of about 45 to 65, and desirably has an Iodine Value of about 50 to 60. More desirably, the Iodine Value of the wax is greater than 50 and even more desirably, in the range of about 52 to 56. The wax includes a triacylglycerol component and a polyol fatty acid partial ester component and generally has a melting point of about 120 to 137° F. (circa 49 to 58° C.). The melting point is generally about 50 to 55° C. (circa 122 to 131° F.) if the wax is used in a container candle. Preferably, the wax has a melting point greater than 124° F. (circa 51° C.).

The fatty acid composition of the triacylglycerols commonly includes a significant amount of C18 fatty acids. In order to achieve a desirable melting/hardness profile, the fatty acids typically include a mixture of saturated (e.g., stearic acid; "18:0" acid) and monounsaturated fatty acids (e.g., 18:1 acids). The unsaturated fatty acids are predominantly monounsaturated 18:1 fatty acids, such as oleic acid. The triacylglycerol component generally has a fatty acid composition which includes about 35 to 55 wt. % total of saturated fatty acids, preferably about 35 to less than 50 wt. %, and desirably 40 to 50 wt. %. The triacylglycerol component generally has a fatty acid composition which includes about 45 to 60 wt. % 18:1 fatty acids, preferably 45 to 55 wt. %, desirably less than 54 wt. %, and even more desirably less than 52 wt. %. The triacylglycerol component generally has a fatty acid composition which includes 30 to about 45 wt. % 18:0 fatty acids, preferably 30 to 40 wt. %, and desirably more than 32 wt. %. The triacylglycerol component generally has a fatty acid composition which includes 5 to 13 wt. % 16:0 fatty acids, and preferably 8 to 12 wt. %.

The fatty acid composition of the triacylglycerol stock is typically selected to provide a triacylglycerol-based material with a melting point of about 49 to 57° C. When the present wax is to be used to produce a container candle, the wax suitably is selected to have a melting point of about 51 to 55° C., since waxes based on such stocks can have advantageous properties for producing container candles. The selection of a triacylglycerol stock with a particular melting point can be done by altering several different parameters. As indicated herein, the primary factors which influence the solid fat and melting point characteristics of a triacylglycerol are the chain length of the fatty acyl chains, the amount and type of unsaturation present in the fatty acyl chains, and the distribution of the different fatty acyl chains within individual triacylglycerol molecules. The present triacylglycerol-based materials are commonly formed from triacylglycerols with fatty acid compositions dominated by C18 fatty acids (fatty acids with 18 carbon atoms). Triacylglycerols with extremely large amounts of saturated 18 carbon fatty acid (also referred to as 18:0 fatty acid or stearic acid) can have melting points which may be too high for the producing the present candles, since such materials may be prone to brittleness and cracking. The melting point of such triacylglycerols may be lowered by including more shorter chain fatty acids and/or unsaturated fatty acids. Since the present triacylglycerol-based materials typically have fatty acid compositions in which C16 and C18 fatty acids predominate, the desired melting point and/or solid fat index can be achieved by altering the amount of unsaturated C18 fatty acids present (predominantly 18:1 fatty acid(s)) and/or including a polyol fatty acid partial ester. The triacylglycerol stocks employed in the present triacylglycerol-based waxes are desirably selected to have a melting point of about 49 to 58° C. (circa 120-137° F.).

The method(s) described herein can be used to provide candles from triacylglycerol-based materials having a melting point and/or solid fat content which imparts desirable molding and/or burning characteristics.

One measure for characterizing the average number of double bonds present in a triacylglycerol stock which includes triacylglycerol molecules with unsaturated fatty acid residues is its Iodine Value. The Iodine Value of a triacylglycerol or mixture of triacylglycerols is determined by the Wijs method (A.O.C.S. Cd 1-25). For example, unprocessed soybean oil typically has an Iodine Value of about 125 to 135 and a pour point of about 0° C. to −10° C. Hydrogenation of soybean oil to reduce its Iodine Value to 90 or less increases the melting point of the material as evidenced by the increased in its pour point to 10 to 20° C. Further hydrogenation can produce a material which is a solid at room temperature and may have a melting point of 70° C. or even higher. Typically, the present candles are formed from triacylglycerol-based waxes which include a triacylglycerol component having an Iodine Value of about 45 to 65, and more desirably about 50 to 60.

Feedstocks used to produce the triacylglycerol component in the present candle stock material have generally been neutralized and bleached. The triacylglycerol stock may have been processed in other ways prior to use, e.g., via fractionation, hydrogenation, refining, and/or deodorizing. Preferably, the feedstock is a refined, bleached triacylglycerol stock. The processed feedstock material may be blended with one or more other triacylglycerol feedstocks to produce a material having a desired distribution of fatty acids, in terms of carbon chain length and degree of unsaturation. Typically, the triacylglycerol feedstock material is hydrogenated to reduce the overall degree of unsaturation in the material and provide a triacylglycerol material having physical properties which are desirable for a candle-making base material.

Suitable hydrogenated vegetable oils for use in the present triacylglycerol-based material includes hydrogenated soybean oil, hydrogenated cottonseed oil, hydrogenated sunflower oil, hydrogenated canola oil, hydrogenated corn oil, hydrogenated olive oil, hydrogenated peanut oil, hydrogenated safflower oil or mixtures thereof. The vegetable oil may be hydrogenated to obtain a desired set of physical characteristics, e.g., in terms of melting point, solid fat content and/or Iodine value. The hydrogenation is typically carried out at elevated temperature, such as 400° F. to 450° F. (about 205° C. to 230° C.), and relatively low hydrogen pressure (e.g., no more than about 25 psi) in the presence of a hydrogenation catalyst. One example of a suitable hydrogenation catalyst, is a nickel catalyst, such as a powdered nickel catalyst provided as a 20-30 wt. % in a solid vegetable oil.

The following discussion of the preparation of a vegetable oil derived candle stock material is described as a way of exemplifying a method for producing the present triacylglycerol-based material. A partially hydrogenated refined, bleached vegetable oil, such as a refined, bleached ("RB") soybean oil which has been hydrogenated to an Iodine Value of about 60-75, may be blended with a second oil seed derived material having a higher melting point, e.g., a fully hydrogenated soybean oil. The resulting blend may be too brittle for use in making a pillar or votive candle. The vegetable oil blend could, however, be blended with a polyol fatty acid partial ester component (e.g., a mixture of glycerol monopalmitate and glycerol monostearate) until the melting point and/or solid fat index of the resulting material had been modified to fall within a desired range. The final candle wax formulation would then include a mixture of a triacylglycerol component and a polyol fatty acid partial ester component.

Polyols which can be used to form the fatty acid partial esters used in the present wax compositions include at least two and, preferably, at least three hydroxy groups per molecule (also referred to as "polyhydric alcohols"). Typically, the polyols have no more than 6 hydroxy groups per molecule and include up to 10 carbon atoms and more commonly no more than 6 carbon atoms. Examples of suitable aliphatic polyols include glycerol, alkylene glycols (e.g., ethylene glycol, diethylene glycol, triethylene glycol and neopentylglycol), pentaerythritol, trimethylolethane, trimethylolpropane, sorbitan and sorbitol. Suitable alicyclic polyols include cyclohexanediols and inositol as well as natural cyclic polyols such as glucose, galactose and sorbose.

The polyol partial esters employed in the present wax compositions have one or more unesterified hydroxyl groups with the remaining hydroxy groups esterified by a fatty acyl group. The fatty acyl groups ("—C(O)R") in the partial esters include an aliphatic chain (linear or branched) and typically have from 14 to 30 carbon atoms. Typically, the partial esters have a fatty acid composition which includes at least about 90 wt. % fatty acyl groups having from about 14 to 24 carbon atoms. More commonly, at least about 90 wt. % of the fatty acyl groups with aliphatic chains having from about 16 or 18 carbon atoms. The fatty acid partial esters typically have an Iodine Value of no more than about 130. Very often, the partial esters are formed from a mixture of fatty acids that has been hydrogenated to have an Iodine Value of no more than about 50, desirably no more than about 10 and, more desirably, no more than about 5.

Fatty acid partial esters of polyols which include no more than about 6 carbon atoms and have three to six hydroxy groups per molecule, such as glycerol, pentaerythritol, trimethylolethane, trimethylolpropane, sorbitol, sorbitan, inositol, glucose, galactose, and/or sorbose, are suitable for use in the present waxes. Glycerol and/or sorbitan partial esters are particularly suitable examples of polyol partial esters which can be used to form the present wax compositions.

Fatty acid monoesters of polyols are particularly suitable for use in the present wax compositions. Suitable examples include glycerol monoesters, e.g., glycerol monostearate, glycerol monopalmitate, and/or glycerol monooleate, and/or sorbitan monoesters, e.g., sorbitan monostearate, sorbitan monopalmitate, and/or sorbitan monooleate. Monoesters which are produced by partial esterification of a polyol with a mixture of fatty acids derived from hydrolysis of a triacylglycerol stock are also suitable for use in the present wax compositions. Examples include monoglycerol esters of a mixture of fatty acids derived from hydrolysis of a partially or fully hydrogenated vegetable oil, e.g., fatty acids derived from hydrolysis of fully hydrogenated soybean oil.

Other examples of suitable polyol partial esters include di- and/or triesters of higher polyols, e.g., include di- and/or triesters of a polyol having 5 hydroxy groups, such as sorbitan. For example, the present wax compositions may include one or more sorbitan triesters of fatty acids having 16 to 18 carbon atoms, e.g., sorbitan tristearate, sorbitan tripalmitate, sorbitan trioleate, and mixtures including one or more of these triesters.

Candles can be produced from the triacylglycerol-based material using a number of different methods. In one common process, the vegetable oil-based wax is heated to a molten state. If other additives such as colorants and/or fragrance oils are to be included in the candle formulation, these may be added to the molten wax or mixed with vegetable oil-based wax prior to heating. The molten wax is then solidified around a wick. For example, the molten wax can be poured into a mold which includes a wick disposed therein. The molten wax is then cooled to the solidify the wax in the shape of the mold. The candle may be used as a candle while still in the mold. Examples of candles which may be produced by this method include container candles and some votive candles.

Although the triacylglycerol stock can be used for many application, including cosmetics, the triacylglycerol stock is well suited for use as candle wax, particularly for container candles. The triacylglycerol stock employed in the present waxes not only has the melting point and degree of hardness desirable in container candle waxes, the present triacylglycerol wax also has the proper surface adhesion characteristics so the wax does not pull away from the container when cooled. Additionally, the present triacylglycerol stock provides a consistent, even appearance when resolidified and does not exhibit undesirable mottling in the candle which results from uneven wax crystallization.

The candle wax may be packaged as part of a candle-making kit, e.g., in the form of beads or flakes of wax, which includes also typically would include instructions with the candle wax. The candle-making kit typically would also include material which can be used to form a wick.

A wide variety of coloring and scenting agents, well known in the art of candle making, are available for use with waxy materials. Typically, one or more dyes or pigments is employed provide the desired hue to the color agent, and one or more perfumes, fragrances, essences or other aromatic oils is used provide the desired odor to the scenting agent. The coloring and scenting agents generally also include liquid carriers which vary depending upon the type of color- or scent-imparting ingredient employed. The use of liquid organic carriers with coloring and scenting agents is preferred because such carriers are compatible with petroleum-based waxes and related organic materials. As a result, such coloring and scenting agents tend to be readily absorbed into waxy materials. It is especially advantageous if a coloring and/or scenting agent is introduced into the waxy material when it is in the form of prilled granules.

The colorant is an optional ingredient and is commonly made up of one or more pigments and dyes. Colorants are typically added in a quantity of about 0.001-2 wt. % of the waxy base composition. If a pigment is employed, it is typically an organic toner in the form of a fine powder suspended in a liquid medium, such as a mineral oil. It may be advantageous to use a pigment that is in the form of fine particles suspended in a vegetable oil, e.g., an natural oil derived from an oilseed source such as soybean or corn oil. The pigment is typically a finely ground, organic toner so that the wick of a candle formed eventually from pigment-covered wax particles does not clog as the wax is burned. Pigments, even in finely ground toner forms, are generally in colloidal suspension in a carrier.

If a dye constituent is utilized, it may be dissolved in an organic solvent. A variety of pigments and dyes suitable for candle making are listed in U.S. Pat. No. 4,614,625, the disclosure of which is herein incorporated by reference. The preferred carriers for use with organic dyes are organic solvents, such as relatively low molecular weight, aromatic hydrocarbon solvents; e.g. toluene and xylene. The dyes ordinarily form true solutions with their carriers. Since dyes tend to ionize in solution, they are more readily absorbed into the prilled wax granules, whereas pigment-based coloring agents tend to remain closer to the surface of the wax.

Candles often are designed to appeal to the olfactory as well as the visual sense. This type of candle usually incorporates a fragrance oil in the waxy body material. As the waxy material is melted in a lighted candle, there is a release of the fragrance oil from the liquefied wax pool. The scenting agent may be an air freshener, an insect repellent or more serve more than one of such functions.

The air freshener ingredient commonly is a liquid fragrance comprising one or more volatile organic compounds which are available from perfumery suppliers such IFF, Firmenich Inc., Takasago Inc., Belmay, Noville Inc., Quest Co., and Givaudan-Roure Corp. Most conventional fragrance materials are volatile essential oils. The fragrance can be a synthetically formed material, or a naturally derived oil such as oil of Bergamot, Bitter Orange, Lemon, Mandarin, Caraway, Cedar Leaf, Clove Leaf, Cedar Wood, Geranium, Lavender, Orange, Origanum, Petitgrain, White Cedar, Patchouli, Lavandin, Neroli, Rose and the like.

A wide variety of chemicals are known for perfumery such as aldehydes, ketones, esters, alcohols, terpenes, and the like. A fragrance can be relatively simple in composition, or can be a complex mixture of natural and synthetic chemical components. A typical scented oil can comprise woody/earthy bases containing exotic constituents such as sandalwood oil, civet, patchouli oil, and the like. A scented oil can have a light floral fragrance, such as rose extract or violet extract. Scented oil also can be formulated to provide desirable fruity odors, such as lime, lemon or orange.

Synthetic types of fragrance compositions either alone or in combination with natural oils such as described in U.S. Pat. Nos. 4,314,915; 4,411,829; and 4,434,306; incorporated herein by reference. Other artificial liquid fragrances include geraniol, geranyl acetate, eugenol, isoeugenol, linalool, linalyl acetate, phenethyl alcohol, methyl ethyl ketone, methylionone, isobornyl acetate, and the like. The scenting agent can also be a liquid formulation containing an insect repellent such as citronellal, or a therapeutic agent such as eucalyptus or menthol. Once the coloring and scenting agents have been formulated, the desired quantities are combined with waxy material which will be used to form the body of the candle. For example, the coloring and/or scenting agents can be added to the waxy materials in the form of prilled wax granules. When both coloring and scenting agents are employed, it is generally preferable to combine the agents together and then add the resulting mixture to the wax. It is also possible, however, to add the agents separately to the waxy material. Having added the agent or agents to the wax, the granules are coated by agitating the wax particles and the coloring and/or scenting agents together. The agitating step commonly consists of tumbling and/or rubbing the particles and agent(s) together. Preferably, the agent or agents are distributed substantially uniformly among the particles of wax, although it is entirely possible, if desired, to have a more random pattern of distribution. The coating step may be accomplished by hand, or with the aid of mechanical tumblers and agitators when relatively large quantities of prilled wax are being colored and/or scented.

Certain additives may be included in the present wax compositions to decrease the tendency of colorants, fragrance components and/or other components of the wax to migrate to an outer surface of a candle. Such additives are referred to herein as "migration inhibitors." The wax may include 0.1 to 5.0 wt. % of a migration inhibitor. One type of compounds which can act as migration inhibitors are polymerized alpha olefins, more particularly polymerization products formed alpha olefins having at least 10 carbon atoms and, more commonly from one or more alpha olefins having 10 to about 25 carbon atoms. One suitable example of such as polymer is an alpha olefin polymer sold under the tradename Vybar® 103 polymer (mp 168° F. (circa 76° C.); available from Baker-Petrolite, Sugarland, Tex.). The inclusion of sorbitan triesters, such as sorbitan tristearate and/or sorbitan tripalmitate and related sorbitan triesters formed from mixtures of fully hydrogenated fatty acids, in the present wax compositions may also decrease the propensity of colorants, fragrance components and/or other components of the wax to migrate to the candle surface. The inclusion of either of these types of migration inhibitors can also enhance the flexibility of the base wax material and decrease its chances of cracking during the cooling processes that occur in candle formation and after extinguishing the flame of a burning candle. For example, it may be advantageous to add up to about 5.0 wt. % and, more commonly, about 0.1-2.0 wt. % of a migration inhibitor, such as an alpha olefin polymer, to the present wax materials.

ILLUSTRATIVE EMBODIMENTS

A number of illustrative embodiments of the present candle wax and candles produced therefrom are described below. The embodiments described are intended to provide illustrative examples of the present wax and candles and are not intended to limit the scope of the invention.

An illustrative embodiment provides a container candle, the container candle having a triacylglycerol based wax and a wick. The triacylglycerol based wax comprises a triacylglycerol component and a polyol fatty acid partial ester component. The triacylglycerol based wax has a melting point of about 49° C.-58° C. and an Iodine Value of about 45 to 65. The triacylglycerol component has a fatty acid composition including 5 to 13 wt. % 16:0 fatty acids. The polyol fatty acid partial ester component preferably includes a glycerol fatty acid monoester component which is about 1 to 5 wt. % of the wax. Also, the wax is preferably made of at least about 70 wt. % of the triacylglycerol component. The container candle also preferably has a glycerol fatty acid monoester component having an Iodine Value of no more than about 10. Also preferably the wax contains no more than about 1 wt. % free fatty acid. Additionally, it is desirable for the triacylglycerol component to have a fatty acid composition including about 35-55 wt. % of saturated fatty acid. It is also desirable for the triacylglycerol component to have a fatty acid composition including about 30 to 45 wt. % 18:0 fatty acid.

Another embodiment comprises a triacylglycerol based wax and a wick. The glycerol based wax comprises a triacylglycerol component and a polyol fatty acid partial ester component. The triacylglycerol based wax has a melting point of about 49° C.-58° C. The triacylglycerol component of the triacylglycerol based wax to has a fatty acid composition including at least about 35 wt. % and less than about 55 wt. % of saturated fatty acid total, and 5 to 13 wt. % 16:0 fatty acid. The polyol fatty acid partial ester component preferably is about 1 to 5 wt. % of the wax and preferably includes a glycerol fatty acid monoester. It is also preferable for the glycerol fatty acid monoester to be 1 to 5 wt. % of the wax. Additionally, the wax is preferably made of at least about 70 wt. % of the triacylglycerol component. The container candle, further, preferably has a glycerol fatty acid monoester component having an Iodine Value of no more than about 10. Also the wax desirably contains no more than about 1 wt. % free fatty acid. Additionally, it is desirable for the triacylglycerol component to have a fatty acid composition including about 30 to 45 wt. % 18:0 fatty acid.

Another embodiment is also directed to a container candle having a triacylglycerol based wax and a wick. The triacylglycerol based wax comprises a triacylglycerol component and a polyol fatty acid partial ester component. The triacylglycerol based wax has a melting point of about 49-58° C. and an Iodine Value of about 45 to 65. The triacylglycerol component has a fatty acid composition including greater than 30 wt. % and no more than 45 wt. % 18:0 fatty acid. The triacylglycerol component preferably has a fatty acid composition including 5 to 13 wt. % 16:0 fatty acids. The polyol fatty acid partial ester component preferably includes a glycerol fatty acid monoester component which is about 1 to 5 wt. % of the wax. Also, the wax is preferably made of at least about 70 wt. % of the triacylglycerol component. The container candle also preferably has a glycerol fatty acid monoester component having an Iodine Value of no more than about 10. Also preferably the wax contains no more than about 1 wt. % free fatty acid. Additionally, it is desirable for the triacylglycerol component to have a fatty acid composition including about 35-55 wt. % of saturated fatty acid.

Another embodiment is directed to a triacylglycerol based wax having a triacylglycerol component and a polyol fatty acid partial ester component. The triacylglycerol based wax has a melting point of about 49-58° C. and an Iodine Value of 45 to 65. The triacylglycerol component of the triacylglycerol based wax has a fatty acid composition including 5-13 wt. % 16:0 fatty acid. The wax preferably has at least 70 wt. % of the triacylglycerol and preferably 1 to 10 wt. % of the polyol fatty acid partial ester. The polyol fatty acid partial ester component preferably includes a glycerol fatty acid monoester component which is about 1 to 5 wt. % of the wax. Also preferably the triacylglycerol component has a fatty acid composition including about 35-55 wt. % saturated fatty acid total. Additionally the triacylglycerol component typically has a fatty acid composition including about 45-60 wt. % 18:1 fatty acid. The wax also contains, preferably, no more than 5 wt. % of the glycerol fatty acid partial ester component. The wax also preferably contains no more than 1 wt. % of the free fatty acid and also, preferably, no more than 1 wt. % paraffin. The polyol fatty acid partial ester preferably has a fatty acid composition including at least 90 wt. % fatty acids having 16-18 carbon atoms. The triacylglycerol component has a fatty acid composition including about 30 to 45 wt. % 18:0 fatty acid.

Another embodiment provides a triacylglycerol based wax having a triacylglycerol component and a polyol fatty acid partial ester component, the triacylglycerol based wax having a melting point of about 49-58° C. The triacylglycerol component of the triacylglycerol based wax has a fatty acid composition including 5-13 wt. % 16:0 fatty acid and at least 35 wt. % and less than 50 wt. % total saturated fatty acid. The wax preferably has at least 70 wt. % of the triacylglycerol and preferably 1 to 10 wt. % of the polyol fatty acid partial ester. The polyol fatty acid partial ester component preferably includes a glycerol fatty acid monoester component which is about 1 to 5 wt. % of the wax. Additionally the triacylglycerol component typically has a fatty acid composition including about 45-60 wt. % 18:1 fatty acid. The wax also contains, preferably, no more than 5 wt. % of the glycerol fatty acid partial ester component. The wax also preferably contains no more than 1 wt. % of the free fatty acid and also, preferably, no more than 1 wt. % paraffin. The polyol fatty acid partial ester preferably has a fatty acid composition including at least 90 wt. % fatty acids having 16-18 carbon atoms. The triacylglycerol component has a fatty acid composition including about 30 to 45 wt. % 18:0 fatty acid.

Another embodiment is directed to a triacylglycerol based wax having at least about 85 wt. % of a triacylglycerol component and about 1-5 wt. % of a glycerol fatty acid mono ester component. The wax has a melting point of about 50° C.-55° C. and an iodine value of about 45-60. The triacylglycerol component has a fatty acid composition which includes about 8-12 wt. % 16:0 fatty acid, about 30-40 wt. % 18:0 fatty acid and about 45-60 wt. % 18:1 fatty acid. The glycerol fatty acid mono ester component preferably has an iodine value of no more than about 10. The wax also preferably contains no more than about 1 wt. % free fatty acid.

Another embodiment is directed to a method of producing a container candle including the steps of heating a triacylglycerol based wax to a molten state, introducing the molten triacylglycerol based wax into a container and solidifying the molten triacylglycerol based wax in the container. The triacylglycerol based wax comprises a triacylglycerol component and a polyol fatty acid partial ester component. The triacylglycerol based wax has a melting point of about 49-58° C. and an iodine value of about 45-65. The triacylglycerol component has a fatty acid composition including greater than 30 wt. % and no more than 45 wt. % 18:0 fatty acid.

Another embodiment is directed to a triacylglycerol based wax having a triacylglycerol component and a glycerol fatty acid mono ester component. The triacylglycerol based wax has a fatty acid composition including about 9-11 wt. % 16:0 fatty acid, 34-37 wt. % 18:0 fatty acid and 50-53 wt. % 18:1 fatty acid. The total saturated fatty acid of the triacylglycerol component is about 45-47 wt. %. The wax is preferably made up of 96-98 wt. % triacylglycerol component and 2-4 wt. % of the glycerol fatty acid mono ester component. The melting point of the triacylglycerol based wax is preferably 50-55° C., and the wax preferably has an Iodine Value of about 51-57. The wax preferably contains no more than 1 wt. % of the free fatty acid and also, preferably, no more than 1 wt. % paraffin. The polyol fatty acid partial ester preferably has a fatty acid composition including at least 90 wt. % fatty acids having 16-18 carbon atoms.

The following example is presented to illustrate the present invention and to assist one of ordinary skill in making and using the same. The example is not intended in any way to otherwise limit the scope of the invention.

EXAMPLE 1

A vegetable oil-based wax suitable which can be used in making votive candles was produced according to the following procedure. A blend of a first partially hydrogenated refined, bleached soybean oil (82 wt. %), a second partially hydrogenated refined, bleached soybean oil (5 wt. %), fully hydrogenated soybean oil (10 wt. %) and 3 wt. % monoglycerol esters of a mixture of fatty acids derived from hydrolysis of hydrogenated soybean oil (available under the tradename Dimodan® from Denisco, Inc., New Century, Kans.) was heated to 170° F. (circa 77° C.) and stirred to thoroughly blend the components. The first partially hydrogenated refined, bleached soybean oil had a melting point of 112-115° F. (circa 44-46° C.) and an Iodine Value of about 62. The second partially hydrogenated refined, bleached soybean oil had a melting point of 89-90° F._(circa 31-33° C.) and an Iodine Value of about 78. The resulting blend had a melting point of 127° F. (53° C.) and an Iodine Value of about 52-56. Typical fatty acid compositions for the triacylglycerol (TAG) fraction of the resulting blend, for the fully hydrogenated soybean oil ("Fully [H] SBO") and for the partially hydrogenated refined, bleached soybean oil with an Iodine Value of 62 are shown in Table 1 below.

TABLE 1

| | Fatty Acid Compositions (Wt. %) | | |
|---|---|---|---|
| Fatty Acid(s) | Fully [H] RB-SBO | 62IV Partially [H] RB-SBO | TAG Fraction of Ex 1 Blend |
| 16:0 | 10-11 | 10.4 | 10.2 |
| 18:0 | 88-89 | 18.3 | 35.5 |
| 18:1 | — | 66.8 | 51.5 |
| 18:2 | — | 2.9 | 0.8 |
| Other | <1 | 1.0 | |

If other additives such as colorants and/or fragrance oils are to be included in the candle formulation, these may be added to the molten triglyceride/glycerol monoester blend or mixed with a blend of the molten triacylglycerol components prior to the addition of the polyol fatty acid monoester component. The final candle formulation may be used to directly produce candles or may be stored in a molten state in a heated tank.

The invention has been described with reference to various specific and illustrative embodiments and techniques. However, it should be understood that many variations and modifications may be made while remaining within the spirit and scope of the invention.

What is claimed is:

1. A candle comprising a triacylglycerol-based wax and a wick disposed within a container;

wherein the triacylglycerol-based wax comprises a triacylglycerol component and a polyol fatty acid partial ester component; and the triacylglycerol-based wax has an Iodine Value of about 45 to 65; and the triacylglycerol component has a fatty acid composition including 5 to 13 wt. % 16:0 fatty acid.

2. The candle of claim 1 wherein the polyol fatty acid partial ester component includes a glycerol fatty acid monoester component; and the wax includes about 1 to 5 wt. % of the glycerol fatty acid monoester component.

3. The candle of claim 1 wherein the wax contains no more than about 1.0 wt. % free fatty acid.

4. The candle of claim 1 wherein the fatty acid composition further includes about 30 to 45 wt. % 18:0 fatty acid.

5. The candle of claim 1 wherein the triacylglycerol component has a fatty acid composition including about 35 to 55 wt. % total saturated fatty acid.

6. The candle of claim 1 wherein the wax comprises at least about 70 wt. % of the triacylglycerol component.

7. A candle comprising a triacylglycerol-based wax and a wick disposed within a container;

wherein the triacylglycerol-based wax comprises a triacylglycerol component and a polyol fatty acid partial ester component; and the triacylglycerol component has a fatty acid composition including 5 to 13 wt. % 16:0 fatty acid; and at least 35 wt. % and less than 50 wt. % total saturated fatty acids.

8. The candle of claim 7 wherein the wax includes about 1 to 5 wt. % of the polyol fatty acid partial ester component.

9. The candle of claim 7 wherein the triacylglycerol component has a fatty acid composition including about 30 to 45 wt. % 18:0 fatty acid.

10. The candle of claim 7 wherein the polyol fatty acid partial ester component includes a glycerol fatty acid monoester component; and the wax includes about 1 to 5 wt. 55 % of the glycerol fatty acid monoester component.

11. The candle of claim 7 wherein the wax comprises at least about 70 wt. % of the triacylglycerol component.

12. A candle comprising a triacylglycerol-based wax and a wick disposed within a container;

wherein the triacylglycerol-based wax comprises a triacylglycerol component and a polyol fatty acid partial ester component;

and the triacylglycerol-based wax has an Iodine Value of about 45 to 65; and the triacylglycerol component has a fatty acid composition including greater than 30 wt. % and no more than 45 wt. % 18:0 fatty acid.

13. The candle of claim 12 wherein the fatty acid composition further comprises about 45 to 60 wt. % 18:1 fatty acid.

14. The candle of claim 12 wherein the polyol fatty acid partial ester component includes a glycerol fatty acid monoester component; and the wax includes about 1 to 5 wt % of the glycerol fatty acid monoester component.

15. The candle of claim 12 wherein the wax comprises at least about 70 wt. % of the triacylglycerol component.

16. A triacylglycerol-based wax comprising a triacylglycerol component and a polyol fatty acid partial ester component;

wherein the triacylglycerol-based wax has an Iodine Value of about 45 to 65; and the triacyiglycerol component has a fatty acid composition including 5 to 13 wt. % 16:0 fatty acid.

17. The wax of claim 16 wherein the triacylglycerol component has a fatty acid composition including about 35 to 55 wt. % total saturated fatty acid.

18. The wax of claim 16 comprising at least about 70 wt. % of the triacylglycerol component; and about 1 to 10 wt % of the polyol fatty acid partial ester component.

19. The wax of claim 16 wherein the fatty acid composition further comprises about 45 to 60 wt. % 18:1 fatty acid.

20. The wax of claim 16 wherein the polyol fatty acid partial ester component includes a glycerol fatty acid monoester component; and the wax includes about 1 to 5 wt % of the glycerol fatty acid monoester component.

21. The wax of claim 16 wherein said wax contains no more than about 1.0 wt. % paraffin.

22. The wax of claim 16 wherein said wax contains no more than about 1.0 wt. % free fatty acid.

23. The wax of claim 16 wherein the polyol fatty acid partial ester has a fatty acid composition including at least 90 wt. % fatty acids having 16 to 18 carbon atoms.

24. The wax of claim 16 wherein the fatty acid composition further comprises about 30 to 45 wt. % 18:0 fatty acid.

25. A triacylglycerol-based wax comprising a triacylglycerol component and a polyol fatty acid partial ester component;

wherein the triacylglycerol component has a fatty acid composition including 5 to 13 wt. % 16:0 fatty acid; and at least 35 wt. % and less than 50 wt. % total saturated fatty acids.

26. The wax of claim 25 wherein the polyol fatty acid partial ester component includes a glycerol fatty acid monoester component.

27. The wax of claim 25 wherein the fatty acid composition further comprises about 45 to 60 wt. % 18:1 fatty acid.

28. The wax of claim 25 wherein the fatty acid composition further comprises about 30 to 45 wt. % 18:0 fatty acid.

29. The wax of claim 25 wherein said wax includes at least about 70 wt. % of the triacylglycerol portion; and about 1 to 5 Wt % of the polyol fatty acid partial ester component.

30. The wax of claim 25 wherein said wax contains no more than about 1.0 wt. % paraffin.

31. The wax of claim 25 wherein said wax contains no more than about 1.0 wt. % free fatty acid.

32. A triacyiglycerol-based wax comprising a triacylglycerol component and a polyol fatty acid partial ester component;

wherein the triacylglycerol-based wax has an Iodine Value of about 45 to 65; and the triacylglycerol component has a fatty acid composition including greater than 30 wt. % and no more than 45 wt. % 18:0 fatty acid.

33. The wax of claim 32 wherein said wax comprises about 1 to 5 wt. % of the polyol fatty acid partial ester component.

34. The wax of claim 32 wherein said wax contains no more than about 1.0 wt. % free fatty acid.

35. The wax of claim 32 comprising at least about 70 wt. % of the triacylglycerol component.

36. The wax of claim 32 containing no more than about 1.0 wt. % paraffin.

37. A triacyiglycerol-based wax comprising at least about 85 wt. % of a triacyiglycerol component and about 1 to 5 wt. % of a glycerol fatty acid monoester component;

wherein the wax has an Iodine Value of about 45 to 60; and the triacylglycerol component has a fatty acid composition which includes about 8 to 12 wt. % 16:0 fatty acid, about 30 to 40 wt. % 18:0 fatty acid, and about 45 to 60 wt. % 18:1 fatty acids.

38. The wax of claim 37 wherein the glycerol fatty acid monoester component has a fatty acid composition which includes at least about 90 wt. % palmitic acid, stearic acid, or a mixture thereof.

39. The wax of claim 37 containing no more than about 1.0 wt. % free fatty acid.

40. The wax of claim 37 containing no more than about 1.0 wt. % paraffin.

* * * * *

UNITED STATES PATENT AND TRADEMARK OFFICE

CERTIFICATE OF CORRECTION

PATENT NO. : 7,637,968 B2
APPLICATION NO. : 10/950127
DATED : December 29, 2009
INVENTOR(S) : Timothy A. Murphy It is certified that error appears in the above-identified patent and that said Letters Patent is hereby corrected as shown below:

In column 14, claim 16, line 56, before "component" replace "triacyiglycerol" with --triacylglycerol--.

In column 15, claim 29, line 28, before "of the polyol" replace "5 Wt %" with --5 wt %--.

In column 16, claim 32, line 1, replace "triacyiglycerol" with --triacylglycerol--.

In column 16, claim 37, line 17, replace "triacyiglycerol" with --triacylglycerol--.

In column 16, claim 37, line 18, before "component" replace "triacyiglycerol" with --triacylglycerol--.

Signed and Sealed this

Eighth Day of June, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,637,968 B2
APPLICATION NO. : 10/950127
DATED : December 29, 2009
INVENTOR(S) : Timothy A. Murphy It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1269 days.

Signed and Sealed this

Ninth Day of November, 2010

David J. Kappos

David J. Kappos
*Director of the United States Patent and Trademark Office*